US007922528B2

(12) United States Patent
Jackson

(10) Patent No.: US 7,922,528 B2
(45) Date of Patent: Apr. 12, 2011

(54) CONNECTOR AND CONNECTOR SYSTEM WITH REMOVABLE TUNING INSULATOR FOR IMPEDANCE MATCHING

(75) Inventor: David H. Jackson, Manlius, NY (US)

(73) Assignee: John Mezzalingua Associates, Inc., E. Syracuse, NY (US)

( * ) Notice: Subject to any disclaimer, the term of this patent is extended or adjusted under 35 U.S.C. 154(b) by 0 days.

(21) Appl. No.: 12/418,075

(22) Filed: Apr. 3, 2009

(65) Prior Publication Data

US 2010/0255717 A1 Oct. 7, 2010

(51) Int. Cl.
*H01R 9/05* (2006.01)

(52) U.S. Cl. ..... 439/578

(58) Field of Classification Search ..... 439/578, 439/63, 581; 333/33, 34, 260
See application file for complete search history.

(56) References Cited

U.S. PATENT DOCUMENTS

| | | | | |
|---|---|---|---|---|
| 3,437,960 | A * | 4/1969 | Ziegler, Jr. | 333/260 |
| 3,460,072 | A * | 8/1969 | Ziegler, Jr. | 333/33 |
| 4,431,255 | A * | 2/1984 | Banning | 439/578 |
| 6,222,500 | B1 | 4/2001 | Koitsalu et al. | |
| 7,168,979 | B2 * | 1/2007 | Cassanego et al. | 439/578 |
| 7,262,672 | B2 | 8/2007 | Lee et al. | |

* cited by examiner

*Primary Examiner* — Phuong K Dinh
(74) *Attorney, Agent, or Firm* — Schmeiser, Olsen & Watts, LLP

(57) ABSTRACT

A connector, and a connector system that implements the connector, that exhibits a value of characteristic impedance that is responsive to a tuning insulator. In one embodiment, the connector includes a connector body that defines a longitudinal axis, and a conductor that is disposed in the connector body so that it is aligned coaxially with the longitudinal axis. The connector also includes a tuning insulator that has a pre-determined effect so that, when the insulator is positioned on a portion of the conductor, the value of characteristic impedance of the connector changes from a first value to a second value.

4 Claims, 4 Drawing Sheets

CONNECTOR AND CONNECTOR SYSTEM WITH REMOVABLE TUNING INSULATOR FOR IMPEDANCE MATCHING

FIELD OF THE INVENTION

The present invention is directed to electrical connectors and adapters, and more specifically, to electrical connectors and adapters that exhibit a value of characteristic impedance that is adjustable.

BACKGROUND OF THE INVENTION

Cable/broadband, telecom, wireless, and satellite industries connect a variety of electrical components, e.g., antennas, amplifiers, diplexers, surge arrestors, with transmission lines, and connectors, to form systems that transmit alternating current electrical signals that can be arranged in an analog and/or digital format. One measure of the success of these systems is the efficiency with which the electrical signals are transmitted amongst these components. Engineers, designers, and technicians in these industries, however, are aware that the level of transmission efficiency that is attained is dependent, in part, on the physical properties of the components that are used in their construction.

Characteristic impedance is one of these properties. More particularly, differences in the characteristic impedance of the components that are connected together can cause problems that affect the transmission efficiency. For example, in a system that includes an antenna, an amplifier, and a transmission line, the differences in the characteristic impedance of the antenna, the amplifier, and the transmission line can cause a portion of the electrical signal transmitted from the amplifier to the antenna to reflect back to the amplifier. This, in turn, can cause standing wave patterns to form in the transmission line when the electrical signal transmitted from the amplifier to the antenna reacts with the electrical signal reflected from the antenna to the amplifier.

Impedance matching is one way to alleviate some of these problems. The goal is to create a system that has a substantially uniform characteristic impedance, which for many systems of the type disclosed and contemplated herein is nominally about 50 ohm, 75 ohm or 90 ohm. Characteristic impedance values that are exhibited by each of the transmission lines and the connectors are determined by a variety of factors, such as, for example, the geometry of the transmission line, the geometry of the connector structure, and the corresponding dielectric material between the conductors. Similarly, the value of characteristic impedance for the connector can be calculated according to the Equation 1 below, $$Z=\sqrt{Z_1 \times Z_2}, \qquad \text{Equation (1)}$$

where Z is the characteristic impedance of the connector, and $Z_1$ and $Z_2$ are the values of characteristic impedance for various components in the system. Accordingly, creating a system having substantially uniform characteristic impedance includes matching the characteristic impedance values of the transmission lines, e.g., coaxial cable, and the connectors that electrically couple the conductors of the transmission lines with other transmission lines, and with the electrical components.

Unfortunately, although mismatches in the characteristic impedance of the transmission lines and the connectors can degrade the quality of the electronic signal, these mismatches are essentially inevitable. In fact, constraints on cost, manufacturing tolerances, and material selection, among other limitations, cause many connectors that are presently available to exacerbate the problem. Despite these issues, efforts that are directed to better balance the value of characteristic impedance of the components, transmission lines, and in particular the connectors, throughout the system have thus far been unsatisfactory, or have resulted in rigid solutions with limited application in systems utilizing higher frequency regimes.

Therefore, a connector is needed that can facilitate impedance balancing amongst the electrical components in these systems, and more particularly, that can help balance the mismatches in high frequency systems so as to improve signal transmission. It is likewise desirable that, in addition to being configured to support a range of values of characteristic impedance, this connector is robust enough so that it can be implemented in a variety of systems and applications.

SUMMARY OF THE INVENTION

The present invention will substantially improve the efficiency that electrical signals are transmitted amongst the components in a system. As discussed in more detail below, connectors that are made in accordance with the concepts of the present invention have a value of characteristic impedance that is adjustable so that the value can be tuned to improve the performance of the system by, for example, changing the return loss of the system.

In accordance with one embodiment, a connector having a characteristic impedance with a first value for use in a system where the characteristic impedance has a nominal value, the connector comprising a conductor extending along a longitudinal axis, a connector body disposed in surrounding relation to the conductor, the connector body including a tuning insulator interface concentric with the longitudinal axis, and a tuning insulator inserted into the tuning insulator interface in a manner encircling at least a portion of the conductor, the tuning insulator having at least one pre-determined effect causing the first value to move toward a second value.

In accordance with another embodiment, a coaxial connector having a value of characteristic impedance, the coaxial connector comprising a conductor extending along a longitudinal axis, a connector body disposed in surrounding relation to the conductor, the connector body including a tuning insulator concentric with the longitudinal axis, and a tuning insulator inserted into the tuning insulator interface in a manner encircling at least a portion of the conductor, the tuning insulator having at least one pre-determined effect causing a first value of the characteristic impedance, wherein the tuning insulator is selected from a plurality of tuning insulators so that the first value substantially equals a nominal value of the characteristic impedance for a system.

In accordance with still another embodiment, a connector system for matching a nominal value of characteristic impedance in a system having at least one component and at least one transmission line, the connector system comprising a connector having a first value of characteristic impedance, the connector including a conductor extending along a longitudinal axis and a connector body in surrounding relation to the conductor, the connector body including a tuning insulator interface concentric with the longitudinal axis, and a plurality of tuning insulators having at least one pre-determined effect causing the first value to move toward a second value when at least one of the tuning insulators encircles the conductor, wherein one or more of the tuning insulators is inserted into the tuning insulator interface in a manner that encircles at least a portion of the conductor.

BRIEF DESCRIPTION OF THE DRAWINGS

For a further understanding of the nature and objects of the invention, references should be made to the following detailed description of a preferred mode of practicing the invention, read in connection with the accompanying drawings in which.

DETAILED DESCRIPTION OF THE INVENTION

Figure 1:
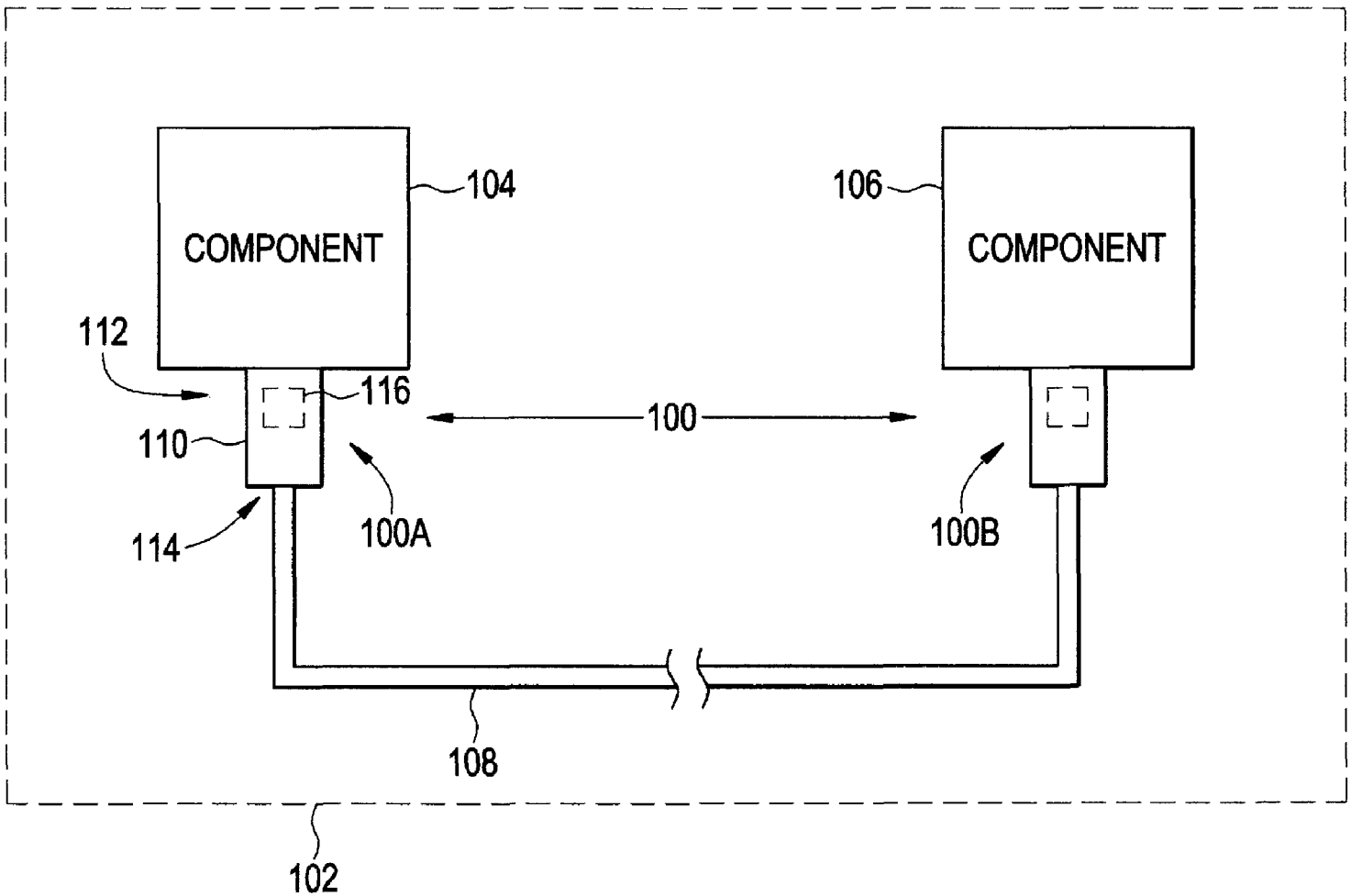
FIG. 1 is a schematic diagram of a system that includes one example of a connector that is made in accordance with concepts of the present invention.

Referring now to the figures, FIG. 1 illustrates an example of a connector 100, e.g., either of connectors 100A-B, that is made in accordance with concepts of the present invention. In the present example, the connector 100 is implemented in a system 102 that includes a first component 104 and a second component 106 that is connected to the first component 104 via a transmission line 108. Exemplary components that are found in systems like system 102 include, but are not limited to, antennas, diplexers, surge arrestors, and amplifiers, as well as other components, like, tuners, radios, oscilloscopes, and any combinations thereof. These are often connected with transmission lines, e.g., transmission line 108, that are typically signal-carrying conductors such as, for example, coaxial cable, shielded cable, optical fiber cable, multi-core cable, ribbon cable, and twisted-pair cable, among others. Selection of the transmission line can vary based on the system in which it is implemented, and so it is expected that the connector 100 will have relative dimensions that are consistent with, and complimentary to, the particular type of transmission line that is selected for transmission line 108. Many of the components and corresponding transmission lines, as well as other components that are not listed or discussed herein but that are contemplated by the concepts of the present disclosure, are found in high frequency systems, such as, for example, antenna systems for wireless devices, satellite links, microwave data links, radio astronomy devices, cellular telephone tower installations, and the like.

As discussed in more detail below, embodiments of the connector 100 have a characteristic impedance with a value that varies in accordance with changes in the configuration of the connector 100. This is beneficial because the systems in which the connectors of the type used as connector 100 are implemented include a variety of components that each exhibit a characteristic impedance that is often different than the other components of the system. As discussed in the Background section above, these differences can substantially reduce the efficiency with which the electrical signals, e.g., analog and/or digital signals, are communicated throughout the system. Changes in the connector 100, on the other hand, can substantially improve transmission efficiency because such changes tune the value of the characteristic impedance of the connector 100 so as to balance the variations between the other components of the system so that the system exhibits a nominal value of characteristic impedance, which is typically about 50 ohm, 75 ohm, or 90 ohm.

Embodiments of the connector 100 include a connector body 110 with a component side 112 and a transmission line side 114 that is located opposite of the component side 112 on the connector body 110. The connector body 110 is generally elongated in shape, with a preferred construction of the connector body 110 including one or more elongated cylindrical sections that interleave, or overlap, to form a substantially rigid outer shell. The embodiments of connector 100 also include a removably replaceable tuning insulator 116 that is inserted into the connector body 110 on the component side 112. As discussed in more detail herein, the tuning insulator 116 may change the characteristic impedance value of the connector 100.

Insulators of the type used as tuning insulator 116 exhibit certain physical properties that can influence the value of the characteristic impedance of the connector 100. In one example of the tuning insulator 116, at least a portion of the tuning insulator 116 is made of dielectric materials, such as, but not limited to, polycarbonate, polyethelyne, TEFLON®, ULTEM®, and any combinations thereof. Air is also a suitable material, such as, for example, if the connector body 110 does not include any tuning insulator 116. It may be desirable, although not necessary, for the tuning insulator 116 to have a pre-determined effect that causes the value of the characteristic impedance of the connector 100 to change from a relatively low impedance value to a relatively high impedance value. In one example, the pre-determined effect of the tuning insulator 116 causes the value of characteristic impedance of the connector 100 to move from a first value to a second value. Preferably, the pre-determined effect can also cause the value of characteristic impedance for the system to move toward the nominal value of characteristic impedance for the system.

For purposes of example only, when the tuning insulator 116 is in place in the connector body 110, the connector 100 has a first value of characteristic impedance. If the tuning insulator is removed from the connector body 110, then the connector 100 exhibits a second value of characteristic impedance that is less than the first value. Likewise, if the tuning insulator 116 is replaced with another tuning insulator 116 that has a different pre-determined value, then the connector 100 exhibits a third value of characteristic impedance that is different from the first and the second values. Such characteristics of the connector 100 are particularly useful because it permits the value of characteristic impedance of the connector 100 to change within a range of values that can help bring the characteristic impedance of the connector 100 to a value that balances the characteristic impedance of the components in the system.

The component side 112 of the connector body 110 is configured to receive the tuning insulator 116 so that it can influence the characteristic impedance of the connector 100. The connector body 110 can releasably secure the tuning insulator 116 in a manner that prevents the tuning insulator 116 from being removed from the connector body 110 without the application of some type of external force. Although exemplary connectors of the type suited for use as connector 100 may include devices, apparatus, or other implementations to secure the tuning insulator 116 inside of the connector body 110, these are generally unnecessary in preferred embodiments of the connector 100. As discussed in more detail below, in one example of the connector 100, the connector body 110 and the tuning insulator 116 are configured so as to frictionally retain the tuning insulator 116 inside of the connector body 110.

The component side 112 is also configured to engage the component, e.g., the components 104, 106, so that the electrical signals are conducted between the connector 100 and the component 104, 106. Preferably, this also permits the electrical signal to be conducted between the transmission line 108 and the component 106, 109. Exemplary connectors for use as connector 100 typically include connective elements for coupling the connector body 110 to these components, such as, for example, screw-threaded fittings, snap fittings, pressure release fittings, deformable fittings, and any combinations thereof. In one example, the connective element on the component side 112 of the connector body 110 is adapted to mate with threaded receptacles on the components 104, 106. In another example, the connective element is selected from the group of connector interfaces consisting of a BNC connector, a TNC connector, an F-type connector, an RCA-type connector, a 7/16 DIN male connector, a 7/16 female connector, an N male connector, an N female connector, an SMA male connector, and an SMA female connector.

In preferred embodiments of the connector 100, the transmission line side 114 is configured to receive and secure a portion of the transmission line 108 so that the electrical signal is conducted between the connector 100 and the transmission line 108. The connector body 110 may include adaptive connectors that are secured to complimentary components on the transmission line 108. It may also include deformable, and/or adaptable portions that are constructed so that they deform about the transmission line 108 to secure the transmission line 108 in the connector body 110. In one example, the transmission line 108 is inserted into the transmission line side 114 of the connector body 110 so that the conductor (not shown) of the transmission line 108 is in electrical communication with a portion of the connector body 110, such as, for example, the mating conductor (not shown) of the connector 100 that is discussed in more detail below. The transmission line side 114 is then deformed, e.g., using a compression tool (not shown), about the portion of the transmission line 108 to secure the connector body 110 onto the transmission line 108.

A detailed discussion of one embodiment of a connector that is suitable for use as the connector 100 is provided in connection with FIGS. 2-4 below. Before continuing with that discussion, however, a brief description of the implementation of the connector 100 as it relates to systems, like the system 102 illustrated in FIG. 1, is discussed immediately below. By way of non-limiting example, in one implementation, a plurality of tuning insulators 116 are provided with the connector 100 in the form of a kit, system, or other organization of components that are suited for use in the system. Each of the tuning insulators in the kit has a pre-determined effect on the characteristic impedance of the connector 100, and in some exemplary kits, the pre-determined effect for each of the tuning insulators is different from the pre-determined effect of the other tuning insulators that are in the kit. In one implementation, each of the tuning insulators has a pre-determined effect that can vary the characteristic impedance of the connector 100 by about 5 ohm. In still other implementations of the connector 100, the kit will include tuning insulators where the pre-determined effect of each of the tuning insulators 116 can vary the characteristic impedance of the connector 100 in increments of about 1 ohm.

In this exemplary implementation, a user, e.g., a technician, can decouple the connector from the component using, for example, hand tools that are consistent with the connective adaptation of the connector side of the connector body. The technician can then insert into the connector, via the connector side, one or more of the exemplary tuning insulators in the kit. This changes the value of characteristic impedance of the connector. In one example, the technician decouples the connector from the component, removes a first tuning insulator that is present in the connector side of the connector body, replaces the first tuning insulator with a second tuning insulator from the kit that has a pre-determined effect that is different that the first tuning insulator, and recouples the connector and the component.

Figure 2:
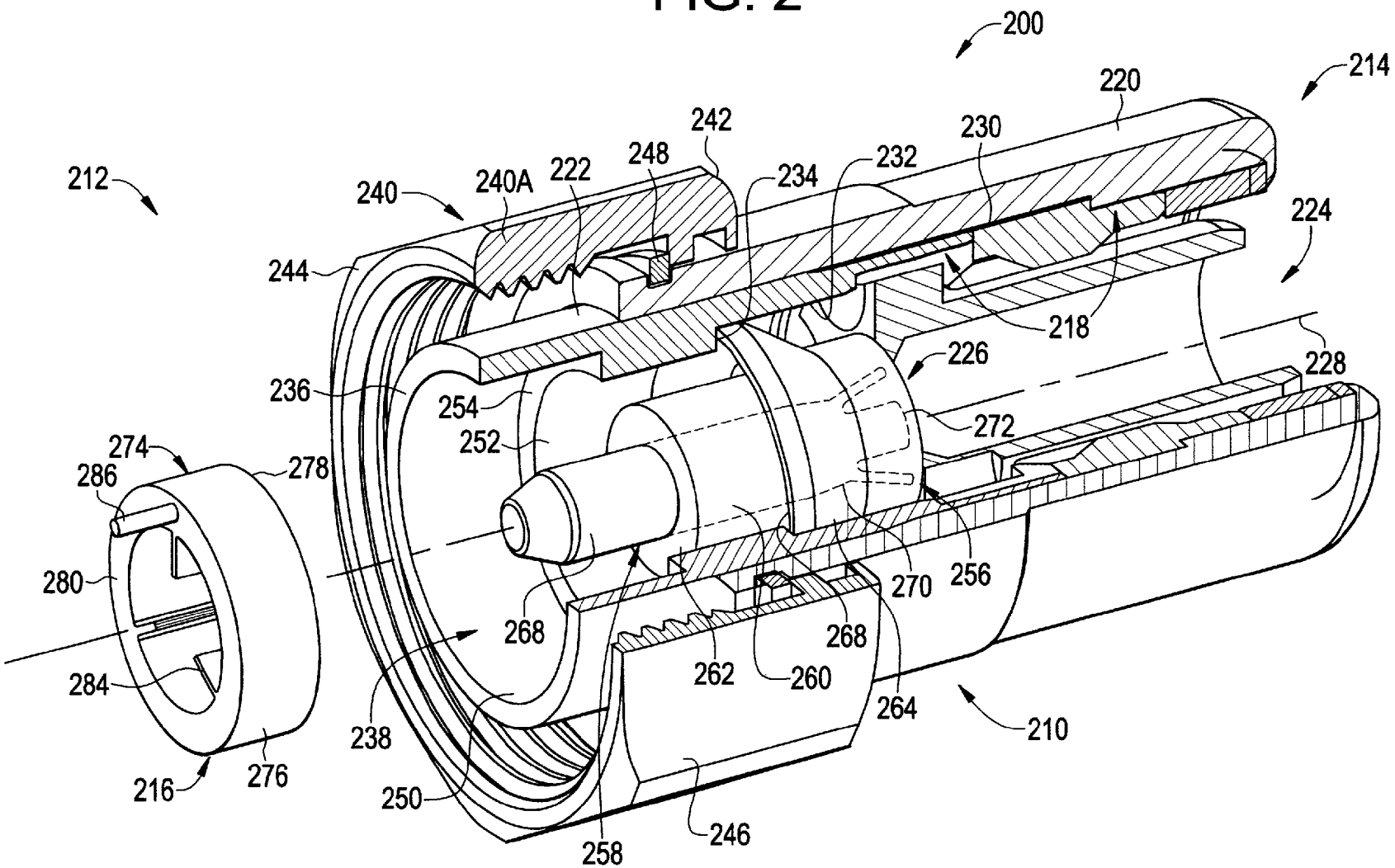
FIG. 2 is a perspective view of a partial cross-section of another example of a connector.

Referring next to the example of a connector 200 that is illustrated in FIG. 2, where some of the portions of the system, e.g., system 102, have been removed for clarity, the connector 200 includes a substantially cylindrical connector body 210 that has a component side 212 that connects to the component (not shown), and a transmission line side 214 that secures together the transmission line (not shown) and the connector body 210. The component side 212 is also configured to replaceably receive a tuning insulator 216, which is shown in the example of FIG. 2 outside of the connector body 210. An example the connector with a tuning insulator of the type used as the tuning insulator 216 inside of the components side of the connector is illustrated and described in connection with FIG. 3 below.

In the present example of the connector 200 of FIG. 2, the connector body 210 has a pair of elongated cylindrical sections 218 that include an outer section 220 and an inner insulated section 222 that is inserted into the outer section 220 so that at least a portion of the insulated section 222 is surrounded by the outer section 220. Discussing the transmission line side 214 of the connector body 210 in more detail, the outer section 220 includes a bore 224 that receives a conductor assembly 226 along a longitudinal axis 228. The inner insulated section 222 has a line end 230 that has a bore 232 that terminates in a stop 234 that locates the conductor assembly 226 in the inner insulated section 222. Turning next to the component side 212 of the connector body 210, the inner insulated section 222 also has a component end 236 that has a tuning insulator interface 238 that surrounds a portion of the conductor assembly 226.

The connector 200 also includes a connective element 240, e.g., threaded nut 240A, that surrounds at least a portion of the tuning insulator interface 238. The threaded nut 240A, as it is illustrated in the present example, is internally threaded so that it can engage the component in a manner that couples the component and the connector body 210. The threaded nut 240A also draws the conductor assembly 226 towards the component so as to facilitate the electrical connection of the component with the connector 200, via electrical contact between the component and the conductor assembly 226, in order to conduct electrical signals amongst the components and transmission lines of the system.

The threaded nut 240A has a first side 242 and a second side 244 that is proximate the insulated interface 238 on the component end 236 of the insulated section 220. As mentioned above, and by way of non-limiting example shown in FIG. 2, the threaded nut 240A is internally threaded so that it can engage the portion of the component that is inserted proximate the insulated interface 238. The threaded nut 240A is generally hex-shaped and includes a plurality of surfaces 246 that enable the threaded nut 240 to be grasped and manipulated by hand or by a tool (not shown) so as to couple the connector 200 to a complimentary fitting (not shown) or other connective end that is found on the component. Further, the threaded nut 240A is retained within its illustrated position with a retaining element 248 that is disposed around a portion of the outer section 218, and that engages the threaded nut 240A proximate the first side 242. Although not shown in the figures, exemplary retaining elements for use as the retaining element 248 include snap rings, o-rings, as well as other features, and devices that provide added assurance that the threaded nut 240A is retained in its intended position.

The tuning insulator interface 238 has a primary bore 250 and a secondary bore 252 that extend contiguously away from the component end 236 into the insulated section 220. As illustrated in the exemplary embodiment of FIG. 2, the primary bore 250 and the secondary bore 252 are delineated by a planar surface 254 so that primary bore 250 extends into the insulated section 220 from the component end 236 to the planar surface 254, and the secondary bore 252 extends into the insulated section 220 from the planar surface 254 so that at least a portion of the secondary bore 254 is aligned coaxially with the longitudinal axis 228. By way of non-limiting example, and as shown in FIG. 2, the inner diameters of the primary bore 250 and the secondary bore 252 are substantially constant, wherein the inner diameter of the primary bore 250 is slightly larger than the inner diameter of the secondary bore 252 so as to form the planar surface 254.

Preferably, the inner diameter of the secondary bore 252 is selected so that the secondary bore 252 can insertably receive at least a portion of the tuning insulator 216 therein. More particularly, and as discussed in more detail below, the inner diameter of the secondary bore 252 may be selected so as to cause the inner surface of the secondary bore 252 to frictionally engage the tuning insulator 216. For example, the inner diameter of the secondary bore 252 may be slightly smaller than the outer diameter of the tuning insulator 216 to create an interference fit that slightly compresses the tuning insulator 216 so as to prevent the tuning insulator 216 from falling out of the secondary bore 252.

The conductor assembly 226 includes a support element 256 and a conductor 258 that conducts electrical signals between the transmission line and the component. The support element 260 has an elongated body portion 260 that has an exposed surface 262, and an outer annular portion 264 that surrounds the body portion 260 and that defines an annular surface 266. The conductor 258 has a component portion 268 that electrically communicates with the component, and a line portion 270 that electrically communicates with the transmission line. The elongated body portion 260, and the outer annular portion 264 are generally of circular cross-section, with the outer diameter of the annular portion 264 being sized so that it can fit inside of the bore 234 of the insulated section 220. This enables the conductor assembly 226 to be inserted into the conductor body 210, via the bore 224 of the outer section 220 on the transmission line side 214, and positioned along the longitudinal axis 228 in the insulated section 222 so that the annular surface 266 substantially mates with the stop 234.

For purposes of example only, it is seen in the example of the connector 200 of FIG. 2 that the line portion 270 forms a plurality of flexible fingers or tines 272, the dimensions (e.g., outer diameter, inner diameter, and length) of which are so dimensioned so that the fingers 272 of the line portion 270 flexibly expand and contract so as to electrically engage a portion of the transmission line, e.g., the conductor (not shown) of the transmission line 108. Moreover, the elongated body portion 260 and the conductor 258 are arranged so that a portion of the conductor 258 extends substantially outwardly from the exposed surface 262. The amount of the conductor 258 that is exposed is generally selected so that, when the tuning insulator 216 is seated against the exposed surface 262, the conductor 258 can make electrical contact with the component when the connector 200 is coupled with the component.

The tuning insulator 216 has a substantially cylindrical body 274 that encircles a portion of the conductor 258 so that the tuning insulator 216 is between the conductor 258 and the connector body 210. Although illustrated and described as touching the conductor 258 herein, it may be desirable in other embodiments of the connector 200 that the tuning insulator 216 is in a spaced relationship to the conductor 258, such as, for example, if there is another insulating material (e.g., air) that is located substantially concentrically between the conductor 258 and the tuning insulator 216.

The cylindrical body 274 includes an outer surface 276, a back surface 278, and a front surface 280. The body 274 further has an interior aperture 282, and a plurality of fins 284 that extend towards the center of the aperture 282. Optionally, a projective element 286 is provided that extends substantially away from the front surface 278.

By way of non-limiting example, and as is illustrated in the example of the connector 200 of FIG. 2, the outer diameter of the cylindrical body 274 of the tuning insulator 216 is selected so that it can be inserted into the secondary bore 252. Exemplary tuning insulators of the type used as tuning insulators 216 are preferably constructed in a manner that prevents the tuning insulator from falling out, or being extricated from, the secondary bore 252 without an external force being applied to the tuning insulator 216. For example, and as mentioned above, embodiments of the connector 200 are configured so that the outer surface 276 of the cylindrical body 274 interferes with the inner surface of the secondary bore 252. This results in frictional and/or compressive forces that hold the tuning insulator 216 in the secondary bore 252. In alternative embodiments of the connector 200, each of the fins 284 may extend sufficiently into the interior aperture 282 to cause one or more of the fins 284 to engage at least a portion of the conductor 256 when the tuning insulator 216 is inserted into the secondary bore 252. This may result in the fins 282 becoming compressed slightly, resulting in a spring force, or spring-like pressure, that is exerted by the fins 282 of the tuning insulator 216 against the conductor 256, which holds the tuning insulator 216 inside of the secondary bore 252. Still other embodiments of the connector 200 may use adhesives, fasteners, or other devices that can secure the tuning insulator 216 inside of the secondary bore 252 but allow the tuning insulator 216 to be removed from the secondary bore 252 by hand, or with hand tools.

Figure 3:
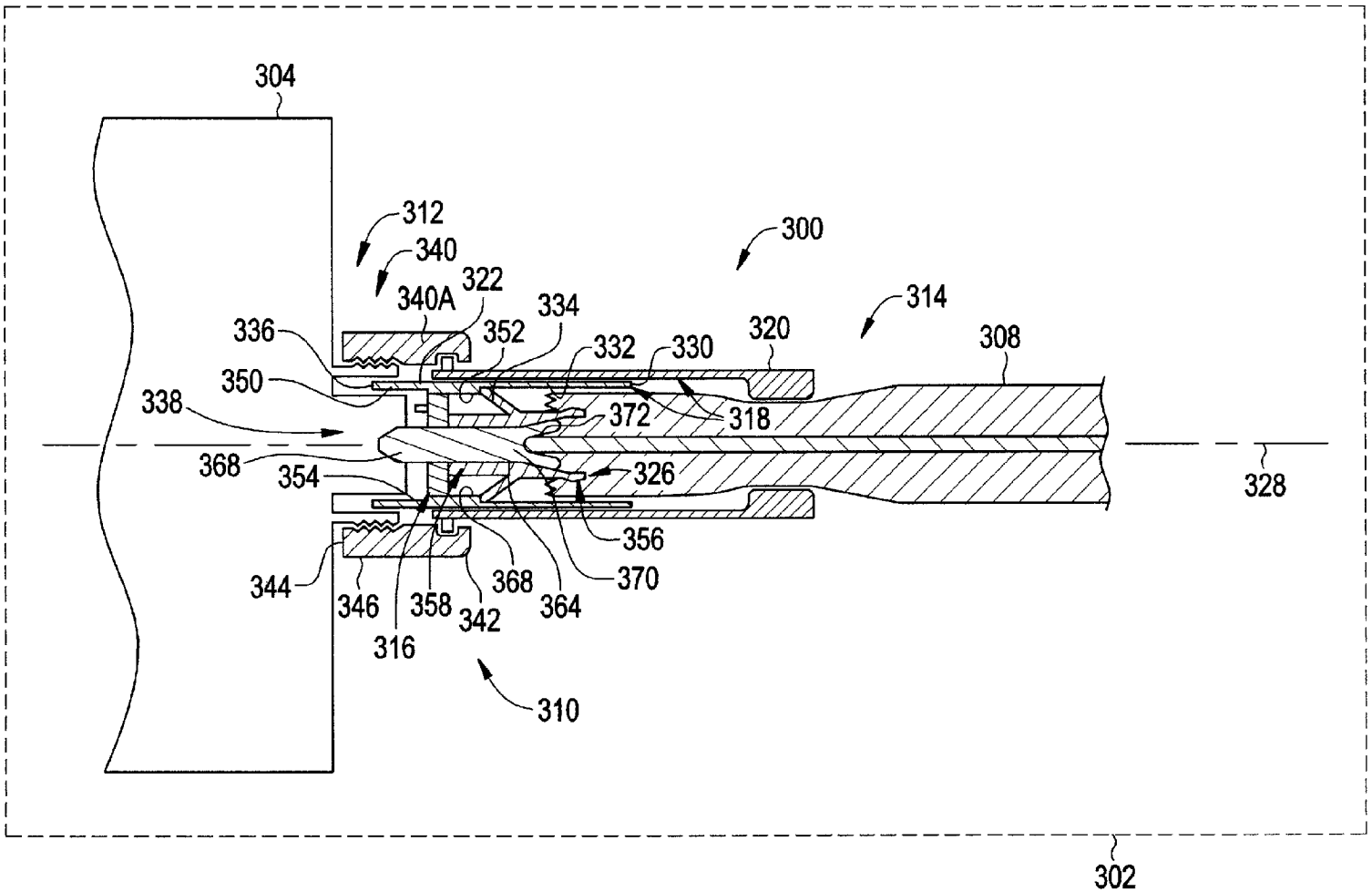
FIG. 3 is a perspective view of a portion of a system that includes another example of a connector that is made in accordance with the concepts of the present invention.

Referring now to FIG. 3, another example of a connector 300 is illustrated where like numerals are used to identify like components, such as those components discussed in connection with FIGS. 1-2 above, but that the numerals are increased by, respectively, 200 and 100. In this example, the connector 300 connects a component 304 and a transmission line 308 with a connector body 310 in a manner that conducts electrical signals across a conductor assembly 326 of the connector 300. By way of example and as is illustrated in FIG. 3, the transmission line 308 is insertably coupled to the transmission line side 314 of the connector body 310, and, more particularly, the transmission line 308 is insertably engaged with the fingers 372 of the line portion 370 of the conductor 358. A tuning insulator 316 is seated in a secondary bore 352 so that the back surface 378 of the tuning insulator 316 substantially mates with the exposed surface 362 of the elongated body portion 360. The component 304 is coupled to the connector body 310, via the threaded nut 340A, so that the component portion 368 of the conductor 356 is electrically coupled with the corresponding electrical receptacle of the component 304.

Figure 4:
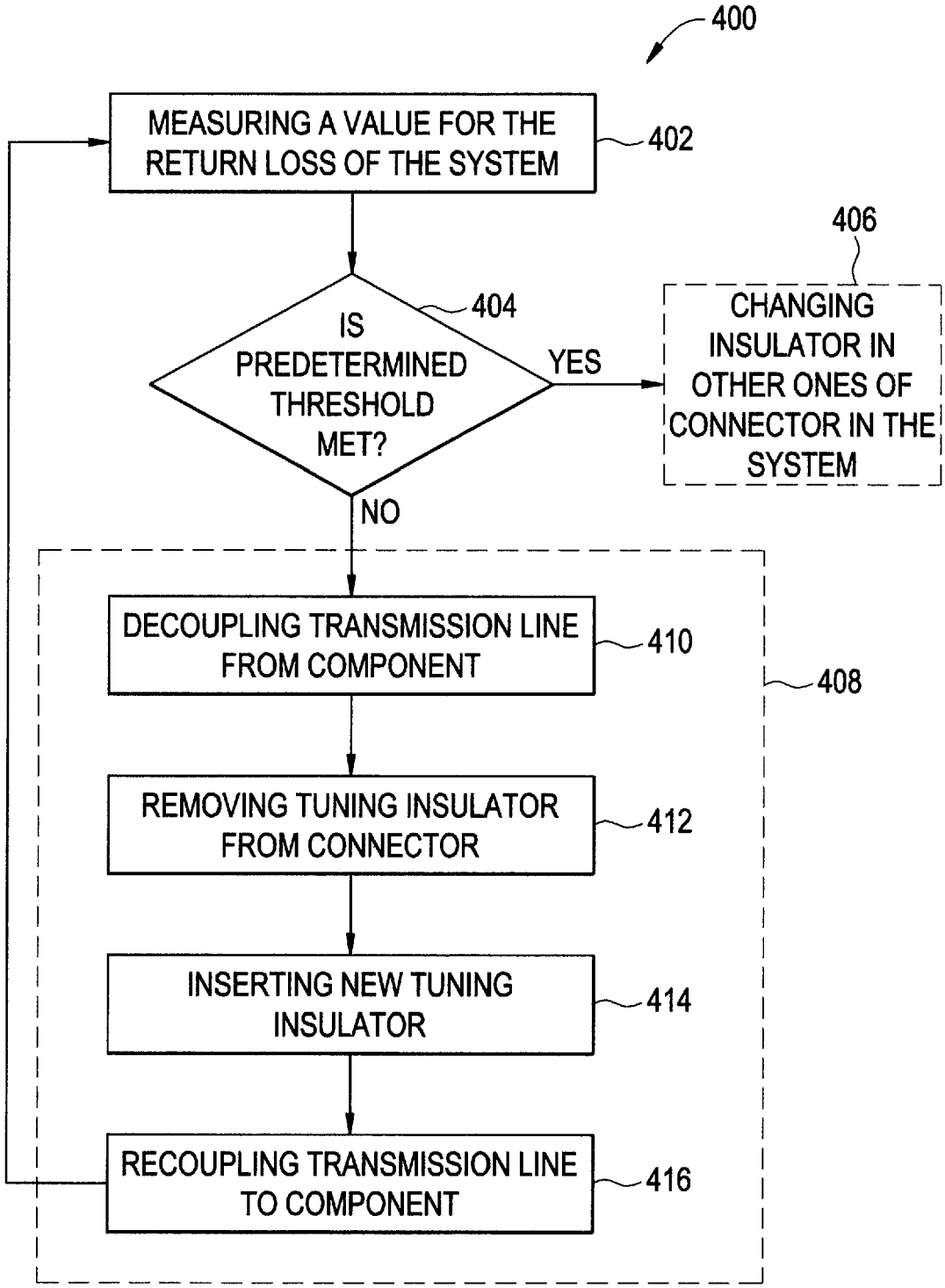
FIG. 4 is a flow diagram of a method of implementing a connector in a system, such as the connectors, and systems of FIGS. 1-3.

Referring next to FIG. 4, and also to FIG. 3, FIG. 4 illustrates a method 400 for adjusting the connector, e.g., connector 300, to improve the efficiency with which a signal is transmitted between the first component 304 and a second component (not shown) via the transmission line 308. Here, the method 400 includes, at step 402, measuring a value, e.g., a first value, of the return loss of the system 302. In one example, the value is measured between the first component 304 and the second component with a network analyzer, such as, for example, the Anritsu Site Master™ manufactured by the Anritsu Company of Morgan Hill, Calif.

Next, the method 400 includes, at step 404, determining if the first value is the value for the return loss that is desired. This may include comparing the first value to a pre-determined threshold level. Examples of the pre-determined threshold level include, but are not limited to, a desired value for the return loss, a maximum value for the return loss, and a minimum value for the return loss, among others. In one embodiment of the method 400, if the first value is equal to about the pre-determined threshold level, or alternatively, it is within a specified acceptable deviation, e.g., about ±0.5, of about the pre-determined threshold level, then the method 400 optionally includes, at step 406, changing the tuning insulator in other ones of connector 300 in the system with a tuning insulator having about the same pre-determined effect as the tuning insulator 316. In another embodiment of the method 400, if the first value is less than about the pre-determined threshold level, then the method 400 optionally continues to step 406. In still another embodiment of the method 400, if the first value is greater than about the pre-determined threshold level, then the method optionally continues to step 406.

If the first value does not meet the pre-determined threshold level in one or more of the manners described above, the method includes, at step 408, adjusting the return loss by changing the tuning insulator 316 in the connector 300. This may include, at step 410, de-coupling the component 304 and the connector 300. In one example, the threaded nut 340A is rotated about the outer section 320 of the connector body 310 in a manner that permits the connector 300 to be removed, either fully or partially, from the component 304. This can be done by hand, or it may require tools, e.g., hand tools, or other devices that can apply a force sufficient to rotate the threaded nut 340A.

The method 400 may also include, at step 412, removing the tuning insulator 316 from the secondary bore 352. In one example, the cylindrical body 374 of the tuning insulator 316 is grasped, or otherwise secured, in a manner that overcomes and/or averts the frictional force between the outer surface 376 and the inner surface of the secondary recess 352. This may be done by hand, such as, for example, by using a finger or fingers to deform the cylindrical body 374, and/or the fins 384 of the tuning insulator 316. In another example, the projective element 386 is grasped, by hand or with hand-tools, and a force is applied that overcomes the frictional forces that retain the tuning insulator 316 in the secondary 352.

The method 400 may further include, at step 414, inserting into the secondary bore 352 another tuning insulator that has a pre-determined effect that is different than the just-removed tuning insulator 316. The new tuning insulator may be selected from a kit, such as the kit discussed above, that includes a plurality of tuning insulators of the type used as tuning insulator 316. Each of the tuning insulators may have a different pre-determined effect on the value of characteristic impedance of the connector 300. If, for example, the return loss of the system must be lowered, then the tuning insulator that is selected will have a pre-determined effect that causes a value for the return loss that is less than the first value caused by the just-removed tuning insulator 316.

After the tuning insulator 316 has been replaced in the secondary bore 352, the method 400 may include, at step 416, re-coupling the component 304 and the connector 300. In one example, the connector 300 is positioned proximate the receptacle on the component so that the threads on receptacle engage the threads on the threaded nut 340A. Here, rotating the threaded nut 340A draws together the receptacle and the tuning insulator interface 238 so that the conductor 356 is electrically coupled to the receptacle on the component.

Method 400 then returns to step 402, measuring a value of the return loss of the system 302, and another value, e.g., a second value, of the return loss of the system is measured that corresponds to the selected tuning insulator. In the present example, the second value is compared to the pre-determined threshold level to determine if the selected tuning insulator in the connector 300 changed the return loss of the system as desired. If the selected tuning insulator does not affect the return loss as desired, and as describe in connection with step 404 above, then the selected tuning insulator is changed, e.g., in accordance with steps 408-416, and the method 400 continues until the value for the return loss that is measured for the system is the value for the return loss that is desired. Then, as discussed above, the method 400 optionally includes, at step 406, inserting a tuning insulator having the same pre-determined effect into other ones of connector 300 that are found in the system.

While the present invention has been particularly shown and described with reference to certain exemplary embodiments, it will be understood by one skilled in the art that various changes in detail may be effected therein without departing from the spirit and scope of the invention as defined by claims that can be supported by the written description and drawings. Further, where exemplary embodiments are described with reference to a certain number of elements it will be understood that the exemplary embodiments can be practiced utilizing either less than or more than the certain number of elements.

What is claimed is:

1. A connector kit for coupling in a system at least one component and at least one transmission line, said connector kit comprising:

a connector having a value of characteristic impedance that is configurable to match a nominal value of characteristic impedance for the system, the connector including a conductor extending along a longitudinal axis and a connector body in surrounding relation to the conductor, the connector body including a tuning insulator interface concentric with the longitudinal axis and accessible from one end of the connector; and a plurality of tuning insulators interchangeable in the tuning insulator interface and having at least one pre-determined effect changing the value of characteristic impedance of the connector, wherein the connector has a first configuration in which the tuning insulator interface is empty, wherein the connector has a second configuration in which one of the tuning insulators is inserted into the tuning insulator interface in a manner that encircles at least a portion of the conductor, and wherein a change from the first configuration to the second configuration changes the value of characteristic impedance of the connector.

2. The system according to claim 1, wherein only one of the tuning insulators encircles the conductor at one time.

3. The system according to claim 2, wherein the tuning insulators cause the value of characteristic impedance to change in increments of about 1 ohm.

4. The system according to claim 1, wherein the connector includes a connective element disposed around the end of the connector body proximate the tuning insulator interface, and wherein the connective element couples the center conductor to the component in the system.

* * * * *